US010822749B2

(12) United States Patent
Dong et al.

(10) Patent No.: US 10,822,749 B2
(45) Date of Patent: Nov. 3, 2020

(54) REINFORCING FABRIC

(71) Applicant: SAINT-GOBAIN ADFORS CANADA, LTD., Grand Island, NY (US)

(72) Inventors: Jie-yi Dong, Oakville (CA); Ashley Smith, Rochester, NY (US); Gabor F. Nagy, Holley, NY (US); Daniel L. Hunt, Calhoun, GA (US); Tao Yu, Wellesley, MA (US)

(73) Assignee: SAINT-GOBAIN ADFORS CANADA, LTD., Grand Island, NY (US)

( * ) Notice: Subject to any disclaimer, the term of this patent is extended or adjusted under 35 U.S.C. 154(b) by 0 days.

(21) Appl. No.: 16/204,786

(22) Filed: Nov. 29, 2018

(65) Prior Publication Data

US 2019/0169802 A1 Jun. 6, 2019

Related U.S. Application Data

(60) Provisional application No. 62/593,707, filed on Dec. 1, 2017.

(51) Int. Cl.

| | |
|---|---|
| ***E01C 7/00*** | (2006.01) |
| ***E01C 5/20*** | (2006.01) |
| ***E01C 23/03*** | (2006.01) |
| ***E01C 7/32*** | (2006.01) |
| ***E01C 11/00*** | (2006.01) |
| ***E01C 11/16*** | (2006.01) |
| ***E01C 7/18*** | (2006.01) |

(52) U.S. Cl.

CPC ..... *E01C 5/20* (2013.01); *E01C 7/185* (2013.01); *E01C 7/187* (2013.01); *E01C 7/325* (2013.01); *E01C 11/005* (2013.01); *E01C 11/165* (2013.01); *E01C 23/03* (2013.01)

(58) Field of Classification Search

CPC ..... E01C 5/20; E01C 7/325; E01C 11/005; E01C 23/03; E01C 7/185; E01C 7/187; E01C 11/165

USPC ..... 404/17, 28, 31, 75, 27

See application file for complete search history.

(56) References Cited

U.S. PATENT DOCUMENTS 4,233,353 A 11/1980 Bondoc et al.
4,726,846 A 2/1988 Jackson et al.
(Continued)

FOREIGN PATENT DOCUMENTS

CA 2719586 A1 5/2011
CA 2719589 A1 5/2011
(Continued)

OTHER PUBLICATIONS

"Roofing," Hometime How-To, 2008, 2 pages, www.hometime.com/Howto/projects/roof_2.htm.
(Continued)

*Primary Examiner* — Raymond W Addie
(74) *Attorney, Agent, or Firm* — Abel Schillinger, LLP; Adrian Lawrence

(57) ABSTRACT

A reinforcing fabric includes at least one glass fiber, wherein the at least one glass fiber includes a binder, the binder including a polymer resin and a filler, the filler including a recycled asphalt shingle. A method of reinforcing pavement with the aforementioned reinforcing fabric can be applied to new and existing pavements.

20 Claims, 1 Drawing Sheet

200

(56) References Cited

U.S. PATENT DOCUMENTS 4,957,390 A 9/1990 Shoesmith
4,992,315 A 2/1991 Zickell et al.
5,017,426 A 5/1991 Greiser et al.
5,052,162 A 10/1991 Bush et al.
5,340,391 A 8/1994 Grzybowski
5,571,596 A 11/1996 Johnson
5,720,933 A 2/1998 Srinivasan
5,848,755 A 12/1998 Zickell et al.
6,039,914 A 3/2000 Gehrke et al.
6,120,838 A 9/2000 Zickell
6,134,856 A 10/2000 Khan et al.
6,194,519 B1 2/2001 Blalock et al.
6,220,329 B1 4/2001 King et al.
6,228,503 B1 5/2001 Zickell
6,228,785 B1 5/2001 Miller et al.
6,286,273 B1 9/2001 Villela et al.
6,296,912 B1 10/2001 Zickell
6,355,132 B1 3/2002 Becker et al.
6,531,200 B2 3/2003 Zickell et al.
6,585,813 B2 7/2003 Kiik et al.
6,887,515 B2 5/2005 Zickell
6,983,571 B2 1/2006 Felton
7,125,601 B1 10/2006 Pinault et al.
7,182,889 B2 2/2007 Aisenbrey
7,198,735 B2 4/2007 Aisenbrey
7,238,408 B2 7/2007 Aschenbeck et al.
7,241,500 B2 7/2007 Shiao et al.
7,541,059 B2 6/2009 Aschenbeck et al.
7,592,066 B2 9/2009 Shiao et al.
7,651,559 B2 1/2010 Whitaker et al.
7,833,339 B2 11/2010 Whitaker et al.
7,838,575 B2 11/2010 Lang et al.
8,168,032 B2 5/2012 Kalkanoglu et al.
8,197,893 B2 6/2012 Leitch et al.
8,349,431 B2 * 1/2013 Lee ..... E01C 11/165 404/73
8,663,418 B2 3/2014 Kalkanoglu et al.
8,882,385 B2 * 11/2014 Yu ..... E01C 11/16 404/31
9,259,860 B2 2/2016 Kalkanoglu et al.
9,273,228 B1 3/2016 Hyer et al.
9,290,944 B2 3/2016 Kalkanoglu et al.
9,605,152 B2 3/2017 Ruan et al.
9,677,277 B2 6/2017 Kalkanoglu et al.
9,790,360 B2 10/2017 Puchalski et al.
10,196,783 B2 * 2/2019 Dempsey ..... E01C 7/18
2001/0007709 A1 7/2001 Phillips et al.
2001/0008674 A1 7/2001 Smith et al.
2002/0011687 A1 * 1/2002 Mischo ..... B29B 17/0026 264/113
2002/0040557 A1 4/2002 Felton
2002/0160151 A1 10/2002 Pinault et al.
2002/0189189 A1 12/2002 Kupczyk
2003/0008094 A1 1/2003 Zickell
2003/0068469 A1 4/2003 Aschenbeck et al.
2003/0091795 A1 5/2003 Kiik et al.
2003/0209305 A1 11/2003 Smith et al.
2003/0224141 A1 * 12/2003 Maupetit ..... B29C 70/202 428/109
2004/0014385 A1 1/2004 Greaves, Jr. et al.
2005/0072110 A1 4/2005 Shiao et al.
2005/0140042 A1 6/2005 Aisenbrey
2005/0166956 A1 8/2005 Aisenbrey
2005/0170141 A1 8/2005 Bacon et al.
2005/0204675 A1 9/2005 Snyder et al.
2005/0233663 A1 10/2005 Lee et al.
2005/0257465 A1 11/2005 Felton
2005/0281999 A1 12/2005 Hofmann et al.
2006/0172638 A1 * 8/2006 Chabal ..... B32B 5/022 442/36
2006/0194023 A1 8/2006 Teng
2006/0265990 A1 11/2006 Kalkanoglu et al.
2007/0020436 A1 1/2007 Teng et al.
2007/0026195 A1 2/2007 Pinault et al.
2007/0039703 A1 2/2007 Lee et al.
2007/0054129 A1 3/2007 Kalkanoglu et al.
2007/0077361 A1 4/2007 Shiao et al.
2007/0144077 A1 6/2007 Quaranta et al.
2007/0261337 A1 11/2007 Whitaker et al.
2008/0029210 A1 2/2008 Swei et al.
2008/0044626 A1 2/2008 Aschenbeck et al.
2008/0060777 A1 3/2008 Wilson et al.
2008/0209825 A1 9/2008 Smith
2008/0220167 A1 9/2008 Wisniewski et al.
2008/0248241 A1 10/2008 Kalkanoglu et al.
2008/0248244 A1 10/2008 Kalkanoglu et al.
2009/0097917 A1 * 4/2009 Newton ..... C09D 133/08 404/70
2009/0098330 A1 4/2009 Lee et al.
2009/0117329 A1 5/2009 Leitch et al.
2009/0163625 A1 6/2009 Lang et al.
2009/0220743 A1 9/2009 Aschenbeck et al.
2009/0229491 A1 9/2009 Harmon
2009/0291260 A1 11/2009 Kiik et al.
2010/0064937 A1 3/2010 Harmon et al.
2010/0126663 A1 5/2010 Kalkanoglu et al.
2010/0129667 A1 5/2010 Kalkanoglu et al.
2010/0151199 A1 6/2010 Shiao et al.
2010/0167013 A1 7/2010 Cruz et al.
2011/0086201 A1 4/2011 Shiao et al.
2011/0104422 A1 5/2011 Kalkanoglu et al.
2011/0104440 A1 5/2011 Kalkanoglu et al.
2012/0141687 A1 6/2012 Kalkanoglu et al.
2013/0065020 A1 3/2013 Loftus et al.
2013/0156501 A1 6/2013 Hemphill
2014/0014000 A1 * 1/2014 Franzen ..... C08L 95/00 106/273.1
2015/0252534 A1 * 9/2015 Dempsey ..... E01C 7/18 404/17
2017/0166723 A1 6/2017 Le et al.
2019/0152850 A1 * 5/2019 Warner ..... C04B 24/06

FOREIGN PATENT DOCUMENTS

CA 2690638 C 4/2013
EP 0199827 A1 11/1986
WO 2000077098 A1 12/2000
WO 2001059230 A1 8/2001

OTHER PUBLICATIONS

Paul Kemp, "Laminated Roofing Vs. Composition Roofing," eHow, 1999, 3 pages, www.ehow.com/facts_7634308_laminated-roofing-vs-composition-roofing.html.
Jericho McCune, "How to Install Laminated Shingles," eHow, accessed Jan. 18, 2013, 1 page, www.ehow.com/how_7280872_install-laminated-shingles.html.
Canadian Office Action with regard to Canadian Application No. 2,690,638, dated Oct. 26, 2011, 3 pages.
International Search Report and Written Opinion for PCT/US2018/063089, dated Mar. 18, 2019, 14 pages.

* cited by examiner

REINFORCING FABRIC

CROSS-REFERENCE TO RELATED APPLICATIONS

This application claims priority under 35 U.S.C. § 119(e) to U.S. Provisional Patent Application No. 62/593,707, entitled "REINFORCING FABRIC", by Jie-yi DONG et al., filed Dec. 1, 2017, which is assigned to the current assignee hereof and incorporated herein by reference in its entirety.

FIELD OF THE DISCLOSURE

The present disclosure relates to a reinforcing fabric and a method of reinforcing pavement therewith.

BACKGROUND

Various methods and composites for reinforcing asphaltic roads and overlays have been proposed. Some describe fiberglass grids impregnated with resins. To repair an old pavement, an asphaltic tack coat is generally applied with fiberglass grids according to construction regulations. The tack coat is applied as a liquid (for example, as an emulsion or hot asphalt cement binder by spraying), and thereafter changes from a liquid to a solid. The tack coat is applied on top of the installed grid with an adhesive coating on the back of the grid, used as an aid in bonding a new asphalt payment to the existing pavement surface. In order to install fiberglass grids without adhesive coating on the back of the grid, the tack coat is firstly applied to an existing pavement. Before the tack coat is fully cured, the grid is laid on the tack coat. As the tack coat cures further, it holds the grid in place on the underlying pavement. The tack coat partially dissolves and merges with the impregnating resin in the grid, when hot asphalt concrete is overlaid on top of the grid. Tack coats have several highly desirable features for use with such reinforcements. In particular, they are compatible with the asphaltic concrete or cement to be used as the overlay, and their fluid nature makes them flow into, and smooth out, rough paving surfaces.

On the other hand, tack coats present several difficulties. The properties of tack coats are very sensitive to ambient conditions, particularly, temperature and humidity. These conditions may affect cure temperature of emulsion tack coats, and in severe conditions, they can prevent cure. In less severe circumstances, the overlay paving equipment must wait until the tack coat has cured, causing needless delays. For example, tack coats are normally emulsions of asphalt in water, often stabilized by a surfactant. To manifest their potential, the emulsion must be broken and water removed prior to lay down a film of asphalt. The water removal process is, essentially, evaporation, which is controlled by time, temperature, and humidity of the environment. Frequently, the environmental conditions are unfavorable, resulting in inefficient tacking or unacceptable delay.

Accordingly, there remains a desire to improve the adhesive bond between pavement courses.

SUMMARY

In an embodiment, a reinforcing fabric is provided. The reinforcing fabric includes at least one glass fiber, wherein the at least one glass fiber includes a binder, the binder including a polymer resin and a filler, the filler including a recycled asphalt shingle.

In another embodiment, a method of reinforcing paving is provided. The method includes providing a reinforcing fabric over a lower layer of paving, wherein the reinforcing fabric includes at least one glass fiber, wherein the at least one glass fiber includes a binder, wherein the binder includes a polymer resin and a filler, the filler including a recycled asphalt shingle. The method further includes applying an upper layer of paving on the reinforcing fabric.

BRIEF DESCRIPTION OF THE DRAWINGS

Embodiments are illustrated by way of example and are not limited in the accompanying figures.

Figure 1:
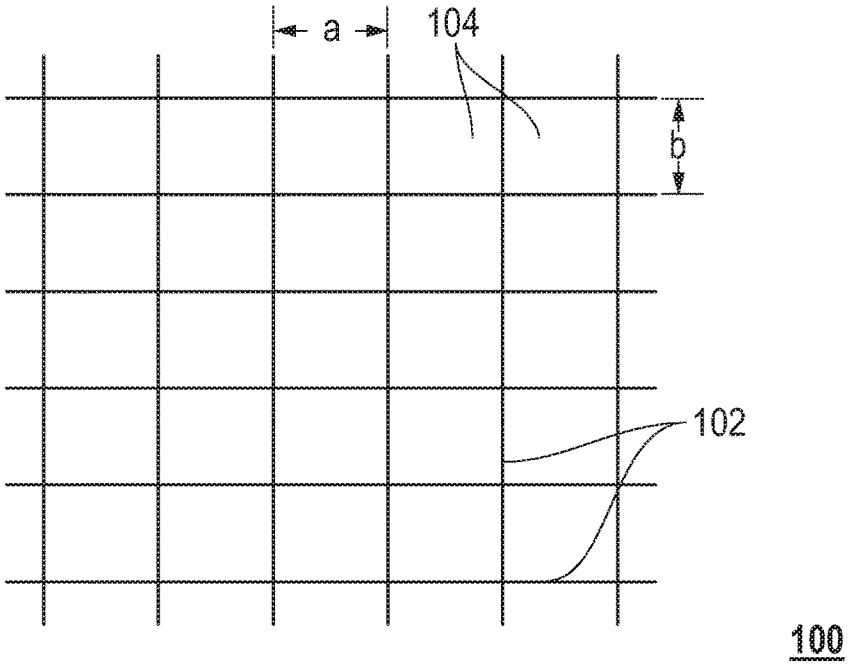
FIG. 1 is a plan view of a reinforcing fabric.

Skilled artisans appreciate that elements in the figures are illustrated for simplicity and clarity and have not necessarily been drawn to scale. For example, the dimensions of some of the elements in the figures may be exaggerated relative to other elements to help to improve understanding of embodiments of the invention.

DETAILED DESCRIPTION

The following description in combination with the figures is provided to assist in understanding the teachings disclosed herein. The following discussion will focus on specific implementations and embodiments of the teachings. This focus is provided to assist in describing the teachings and should not be interpreted as a limitation on the scope or applicability of the teachings. However, other teachings can certainly be used in this application.

Before addressing details of the embodiments described below, some terms are defined or clarified. As used herein, the terms "comprises", "comprising", "includes", "including", "has", "having" or any other variation thereof, are intended to cover a non-exclusive inclusion. For example, a method, article, or apparatus that comprises a list of features is not necessarily limited only to those features but may include other features not expressly listed or inherent to such method, article, or apparatus. Further, unless expressly stated to the contrary, "or" refers to an inclusive-or and not to an exclusive-or. For example, a condition A or B is satisfied by any one of the following: A is true (or present) and B is false (or not present), A is false (or not present) and B is true (or present), and both A and B are true (or present).

Also, the use of "a" or "an" is employed to describe elements and components described herein. This is done merely for convenience and to give a general sense of the scope of the invention. This description should be read to include one or at least one and the singular also includes the plural, or vice versa, unless it is clear that it is meant otherwise. For example, when a single embodiment is described herein, more than one embodiment may be used in place of a single embodiment. Similarly, where more than one embodiment is described herein, a single embodiment may be substituted for that more than one embodiment.

This description of the exemplary embodiments is intended to be read in connection with the accompanying drawings, which are to be considered part of the entire written description. In the description, relative terms such as "lower", "upper", "horizontal", "vertical", "above", "below", "up", "down", "top" and "bottom" as well as derivative thereof (e.g., "horizontally", "downwardly", "upwardly", etc.) should be construed to refer to the orientation as then described or as shown in the drawing under discussion. These relative terms are for convenience of description and do not require that the apparatus be constructed or operated in a particular orientation.

Unless otherwise defined, all technical and scientific terms used herein have the same meaning as commonly understood by one of ordinary skill in the art to which this invention belongs. The materials, methods, and examples are illustrative only and not intended to be limiting. To the extent not described herein, many details regarding specific materials and processing acts are conventional and may be found in reference books and other sources within the structural arts and corresponding manufacturing arts.

The present invention provides a reinforcing fabric. The reinforcing fabric includes at least one glass fiber. The at least one glass fiber includes a binder, the binder including a polymer resin and a filler. The filler includes a recycled asphalt shingle. The reinforcing fabric is typically used with paving. "Paving" as used herein refers to roads, roadways, and surfaces and includes airports, sidewalks, driveways, parking lots and all other such paved surfaces. The reinforcing fabric as described has a desirable adhesive behavior for paving applications compared to conventionally available reinforcing fabrics without any recycled asphalt shingle filler. More particularly, the binder is designed to provide enhanced adhesion compared to conventionally available reinforcing fabric. Exemplary advantageous properties of the reinforcing fabric can be seen in the subsequent description and Examples.

In a particular embodiment, the reinforcing fabric includes any reasonable binder on the at least one glass fiber that forms a bond compatible with asphaltic paving. A reasonable binder includes a polymer resin, such as a synthetic polymer resin. Exemplary synthetic polymer resins include, but are not limited to, a styrene-based polymer such as styrene-butadiene rubber (SBR), poly vinyl chloride (PVC), poly(vinylidene chloride) (PVDC), an acrylic polymer, a polyvinyl alcohol, a polyvinyl acetate, an olefinic polymer, an ethylene vinyl acetate copolymer (EVA), a polyamide, an acrylamide, a vinyl ester, or combination thereof. In an embodiment, the binder can include polymer resin such as a styrene-based polymer, an acrylic polymer, or combination thereof. In an embodiment, the polymer resin comprises a styrene butadiene resin, a styrene acrylic resin, or combination thereof. In a particular embodiment, the polymer resin is a carboxylated styrene butadiene rubber. In an alternative embodiment, the styrene butadiene rubber is not carboxylated.

Any reasonable amount of polymer resin is envisioned. In an embodiment, the polymer resin is present as a majority portion of the binder, such as at least 50% by weight, such as at least 60% by weight, such at least 70% by weight, or even at least 80% by weight of a dry coating based on total binder formulation. In an embodiment, the polymer resin is present at an amount of 50% by weight to 95% by weight, such as 50% by weight to 90% by weight, such as 50% by weight to 80% by weight, or even 50% by weight to 75% by weight of a dry coating based on total binder formulation.

In an exemplary embodiment, the binder includes a filler. The filler includes a recycled asphalt shingle. In a more particular embodiment, the recycled asphalt shingle is a fiberglass-based recycled asphalt shingle, which includes, at least fiberglass and asphalt. The recycled asphalt shingle can include post-industrial roofing articles, pre-consumer roofing articles, post-consumer roofing articles, or any combination thereof. Post-industrial roofing articles can include partially or completely manufactured roofing articles that remain within the possession of the manufacturer. An example of a recycled roofing article can include a post-industrial roofing article that does not meet a product specification. Post-consumer roofing articles can include roofing articles that have been installed on a structure owned or controlled by a consumer, such as a homeowner or a business. Pre-consumer roofing articles are completely manufactured roofing articles outside the possession of the manufacturer and before the roofing articles are installed. An example of pre-consumer roofing articles can include a bundle of shingles that is damaged by a shipping company or a roofing contractor during shipping or handling, or obsolete products, such as roofing articles with outdated colors or designs, or expired products (e.g., a product that should not be installed on a roof due to age of the product). In an embodiment, the recycled asphalt shingle is formed into a powder. For instance, the recycled asphalt shingle is processed and ground to provide for a desirable particle size. Any particle size is envisioned that provides a stable, workable binder formulation with or without dispersion additives. In an embodiment, the recycled asphalt shingle has a particle size wherein 90% of the particles are less than about 1,300 microns, less than about 1,000 microns, less than about 500 microns, less than about 100 microns, less than about 50 microns, or even less than 34 microns, as measured by Malvern Morphologic G3S image analysis. In an embodiment, the recycled asphalt shingle has a volumetric size distribution wherein 90% of the particles are less than 360 microns, as measured by a Beckman Coulter laser diffraction analysis. In an embodiment, the dispersion additive is any reasonable chemical component that aids the dispersion of the filler within the polymer resin. When present, the dispersion additive may be at any reasonable amount.

Any reasonable amount of recycled asphalt shingle is envisioned in the binder. For instance, the recycled asphalt shingle is present at about 1% by weight to about 99% by weight, such as about 1% by weight to about 80% by weight, such as about 1% by weight to about 50% by weight, such as about 5% by weight to about 50% by weight, such as about 5% by weight to about 40% by weight, such as about 10% by weight to about 40% by weight, or even about 10% to about 30% by weight of a dry coating based on total binder formulation. In an embodiment, the chemical nature of the binder with the recycled asphalt shingle filler allows some degree of physical and/or chemical bonding due to Vander Waals attraction to any exposed aggregate, asphalt or the like. In a particular embodiment, both the physical and chemical processes improve shear adhesion between paving surfaces, improving the shear strength.

Any other reasonable additives may be included in the binder. For instance, any reasonable additive includes an additional polymer, a solvent, a defoamer, a crosslinker, an additional filler, a plasticizer, a dispersion agent, an anti-blocking agent, a releasing agent, a rheology modifier, a film forming facilitator, a wetting agent, or combination thereof. In an embodiment, the crosslinker is present dependent upon the polymer resin chosen for the binder. Any crosslinker is envisioned that provides increased hardening to the polymer resin. In an embodiment, the additional filler includes calcium carbonate, talc, an inorganic particle with a metal coating, carbon black, or combination thereof. In an embodiment, the binder is substantially free of any other additives described. In a particular embodiment, the binder is substantially free of calcium carbonate. In an embodiment, the binder is substantially free of any virgin asphalt. "Virgin asphalt" is differentiated from the recycled asphalt shingle in that the recycled asphalt shingle contains asphalt that has been processed into a roofing product whereas virgin asphalt is typically an emulsified asphalt yet to be processed into a final product. "Substantially free" as used herein refers to less than about 0.1 wt %, or even less than about 0.01 wt % of a dry coating based on total binder formulation.

In an embodiment, the viscosity of the binder is selected so that it penetrates into the strands of the at least one glass fiber. The binder is generally uniformly spread across a surface of the at least one glass fiber to coat the at least one glass fiber and impart a semi-rigid nature to the at least one glass fiber, and cushion and protect the at least one glass fiber from corrosion by water, salt, oil and other elements in the roadway environment. In an embodiment, the binder uniformly coats the entire surface of the at least one glass fiber. The uniform coating also reduces abrasion between glass fibers and the cutting of one glass fiber by another. In an embodiment, any thickness of the binder on the at least one glass fiber is envisioned. For instance, the thickness of the binder is up to about 0.2 inches, such as about 0.05 inches to about 0.10 inches, such as about 0.05 inches to about 0.08 inches and is substantially homogenous and uniform such that an entire surface of the reinforcing fabric is coated with the binder. In an embodiment, the binder is present at any reasonable amount on the reinforcing fabric. For instance, the binder is present on the reinforcing fabric in an amount of about 1% by weight to about 50% by weight, such as about 1% by weight to about 30% by weight, or even about 5% by weight to about 15% by weight based on the total weight of the reinforcing fabric. In an embodiment, the binder provides a coating weight of up to 4.0 ounces/square yard (oz./yd$^2$), such as up to 3.0 oz./yd$^2$, such as up to 2.0 oz./yd$^2$, such as up to 1.0 oz./yd$^2$.

In an embodiment, the reinforcing fabric may be of any reasonable configuration. For instance, the reinforcing fabric includes at least one glass fiber configured as a grid that includes any number of strands oriented in any reasonable orientation. As used herein "strand" includes a twisted or untwisted bundle or assembly of continuous filaments used as a unit, including slivers, toes, ends, yarn and the like. Sometimes a single fiber or filament is also called a strand. In an embodiment, the grid includes two sets of strands oriented in any reasonable orientation. Any reasonable orientation includes any angle between 0 degrees and 180 degrees. For instance, the first set of strands run in one direction and the second set of strands run in a second direction. In an embodiment, the grid includes a first set of strands running lengthwise in long lengths and approximately parallel with the second set of strands running perpendicular (i.e. 90 degrees) to the first set of strands. In a particular embodiment, the first set of strands and the second set of strands provide openings between the strands and their intersection points. In an embodiment, the openings permit asphalt to substantially encapsulate at least one surface of the reinforcing fabric. In an exemplary embodiment, the openings permit asphalt to encapsulate each strand of the reinforcing fabric completely, and permit complete and substantial contact between the reinforcing fabric and an upper asphaltic layer and a lower asphaltic layer. The reinforcing fabric substantially bonds the lower asphalt layer and the upper asphalt layer through the openings of the reinforcing fabric to permit substantial transfer of stresses from the lower asphalt layer and the upper asphalt layer to the strands of the reinforcing fabric.

In a particular embodiment, the at least one glass fiber may include any reasonable fiberglass. An exemplary fiberglass includes E-glass, C-glass, A-glass, S-glass, E-CR glass, a combination thereof, and the like. Any weight of the fiberglass is envisioned, such as about 300 to about 5000 tex, or even about 300 tex to about 1000 tex. In an embodiment, the fiberglass yarns have a strand strength of about 560 pounds per inch (lbs/in) or more when measured in accordance with ASTM D6637, with an elongation at break of 5% or less. In an embodiment, the strands have a mass/unit area of less than about 22 oz./yd$^2$ (740 g/m$^2$), such as less than about 11 oz./yd$^2$ (370 g/m$^2$). Although primarily described with fiberglass, any reasonable high modulus fibers are envisioned. In an embodiment, the high modulus fiber includes, for example, polyethylene terephthalate, known as polyester or PET, polyamide fibers of poly(p-phenylene terephthalamide), known as Kevlar®, and the like.

In an embodiment, these strands of the reinforcing fabric, may be low twist (i.e., about one turn per inch or less). In an exemplary embodiment, the strands are formed into grids with rectangular or square openings. Any reasonable opening size is envisioned. In a particular embodiment, the opening ranges in size from ¾ inch to 1 inch on a side though grid opening ranging from ⅛ inch to 6 inches on a side may be used. In some embodiments, the reinforcing fabric may be a fiberglass GlasGrid® product, available from Saint-Gobain ADFORS.

In an embodiment, the reinforcing fabric may include other means to fix the strands at their intersection points. In addition to the binder, the means to fix the strands include thread at intersections. Not to be bound by theory, the fixed strands provide strength to the reinforcing fabric by permitting forces parallel to one set of strands to be transferred, in part, to another set of parallel strands.

The binder can be applied to the at least one glass fiber by any reasonable method. The at least one glass fiber may be coated with the binder before forming the grid (i.e. by coating the filament or yarn), in-line concurrently with formation of the grid, or off-line coating after formation of the grid. In an embodiment, the binder can be applied in at least one layer or at least one pass. The number of layers or passes of the binder typically depends on the material chosen for the grid as well as its construction. The number of applications of the binder may be dependent upon the desired amount of coating to provide a reinforcing fabric. Furthermore, the number of applications of the binder may be dependent on the desired porosity for the final reinforcing fabric. "Porosity" as used herein may be dependent upon the intersections of the yarns to allow for openings between the spacing of the yarns as well as dependent on the amount of binder applied on the yarns. For instance, less spacing between the yarns provides lower porosity compared to greater spacing between the yarns.

In an embodiment, the reinforcing fabric may have an optional coating to impart further properties to the reinforcing fabric. In a particular embodiment, the optional coating may provide, for example, reduced porosity, increased adhesion to an adjacent surface, improved strength, reduced water resistance, or any combination thereof. The optional coating is distinguished from the binder used to bond the at least one glass fiber together but may be the same or different composition. Any reasonable composition for the optional coating is envisioned. In an embodiment, the optional coating may be a resinous mixture containing one or more resins. For instance, the rein may be a thermoplastic resin or a thermoset resin. In a particular embodiment, the optional coating may include an alkali-resistant formulation, a water repellant, a flame retardant, a dispersant, a catalyst, a filler, the like, and combinations thereof.

The reinforcing fabric may be used for asphaltic applications. For instance, the reinforcing fabric may be used to repair and reinforce paving. In an embodiment, the reinforcing fabric may be used as to provide an adhesive bond between asphaltic layers. A method of repairing paving includes providing a reinforcing fabric over a lower layer of paving. In a particular embodiment, the reinforcing fabric is in direct contact with the lower layer of paving. Typically, the lower layer of paving is an existing pavement, which can be concrete, asphalt, or a mixture thereof. An upper layer of paving is then applied on the reinforcing fabric. Typically, the upper layer of paving is asphalt. In a particular embodiment, the upper layer has a thickness of at least about 1.5 inches (40 mm).

Once the upper layer is applied, the binder of the reinforcing fabric is activated at a paving temperature, pressure, or both, to form the adhesive bond compatible with the asphaltic paving. In an embodiment, the activation temperature is at a temperature of less than about 300° F., such as at a temperature of about 250° F. to about 285° F.

The binder including the recycled asphalt shingle filler provides desirable properties not yet before achieved with a reinforcing fabric. In particular, the use of the recycled asphalt shingle filler helps provide a desirable adhesive bond to the reinforcing fabric, the lower asphaltic layer and the upper asphaltic layer. Although not to be bound by theory, the use of the recycled asphalt shingle filler provides an increased surface roughness to the reinforcing fabric compared to a conventional reinforcing fabric having a binder without the recycled asphalt shingle filler. The increased surface roughness is theorized as providing an increased surface area of the binder, which provides the increased adhesion of the reinforcing fabric to the adjacent asphaltic layers. In an embodiment, the reinforcing fabric provides desirable adhesion to the adjacent layers of asphaltic paving without any use of a tack film.

The resulting reinforcing fabric has a high modulus and a high strength to cost ratio with its coefficient of expansion approximating that of road construction materials. Accordingly, the reinforcing fabric has properties such as desirable flex fatigue, wear, strength, adhesion to asphalt, and the like. The reinforcing fabric may have a minimum strength of about 100 kN per meter (kN/m) in the direction of each set of parallel strands, such as about 125 kN/m, or even about 150 kN/m or more, with less than about 10%, or even less than 5% elongation at break. In an embodiment, the reinforcing fabric also has desirable tensile strength and shear strength. For instance, the reinforcing fabric has an increased tensile strength compared to a binder without the recycled asphalt shingle filler. For instance, the tensile strength in a machine direction (i.e. along the length of the reinforcing fabric) is greater than 500 pounds (lbs.), such as greater than 550 lbs., or even greater than 600 lbs. In an embodiment, the tensile strength in a cross direction (i.e. a width that is perpendicular to the machine direction) is greater than 500 lbs., such as greater than 550 lbs., or even greater than 600 lbs. In an embodiment, the interlaminar bond between the lower asphaltic layer and the upper asphaltic layer with the reinforcing fabric there between is improved compared to an interlaminar bond when a reinforcing fabric with a binder without the recycled asphalt shingle filler is used. In an embodiment, the shear strength in a four inch diameter puck, including the reinforcing fabric, the lower asphaltic layer, and the upper asphaltic layer is at least about 1 kN, such as at least about 2 kN, or even greater than about 5 kN.

The reinforcing fabric may further include an optional release liner, an optional release coating, an optional tack film, or any combination thereof. In an embodiment, the tack film may be present and may include any material that provides increased adhesion to an adjacent layer, such as, for example, the reinforcing fabric and an adjacent layer of asphalt. Exemplary types of resins that may be used as a tack film may plastically flow at paving temperature, pressure, or both. Primary examples are polyvinyl chloride (PVC), nylon, acrylic, polyolefin such as high density polyethylene (HDPE) and polypropylenes, and ethylene vinyl acetate (EVA) which may provide desired rigidity, compatibility, and corrosion resistance. In an embodiment, the reinforcing fabric does not contain any optional tack film.

In a particular embodiment, the release liner may be provided on any reasonable surface of the reinforcing fabric. Any reasonable release liner, release coating, or combination thereof is envisioned for ease of handling. In particular, the release liner, release coating, or combination thereof may prevent a surface of the reinforcing fabric from adhering to another surface prior to application to a paving surface. For instance, the reinforcing fabric is typically stored and transported in a wound state and in a particular embodiment, the release liner, release coating, or combination thereof provides ease of handling as the reinforcing fabric is unwound. In an embodiment, any release coating may be envisioned, such as a liquid release coating having any suitable thickness or composition for its intended purpose. In an embodiment, a release liner is used, the release liner including any suitable material, dimensions, or forms that enable the release liner to be removed easily and manually without altering the physical or functional properties of the reinforcing fabric.

Turning to FIG. 1, an exemplary reinforcing fabric 100 is illustrated. The reinforcing fabric 100 may be any of a variety of reinforcing materials. As seen in FIG. 1, an open grid is illustrated including at least two sets of substantially parallel strands 102 is provided. Each set of strands 102 includes openings 104 between adjacent strands 102, and the sets are oriented at a substantial angle to one another (e.g., optionally approximately 90 degrees). In some embodiments, the reinforcing fabric 100 may be woven, such as a weft-inserted warp knit. Any weave is envisioned. Although a knit is described, the reinforcing fabric 100 may be nonwoven, such as a nonwoven scrim. Although the openings 104 are illustrated as square, the dimensions "a" and "b" may be dissimilar, such as in the case of a rectangle. Although not illustrated, the binder is substantially homogenous and uniform such that the entire surface of the reinforcing fabric 100 is coated with the binder. In other words, the binder substantially encapsulates the reinforcing fabric 100. In a particular embodiment, the binder does not substantially close the openings between the strands.

Figure 2:
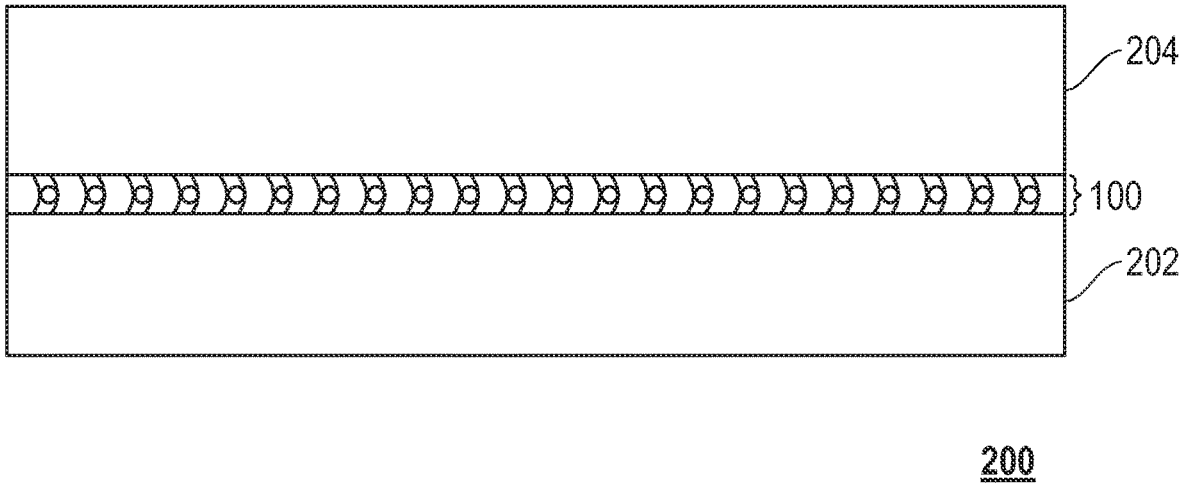
FIG. 2 includes a partial cross-sectional illustration of a repaved section of asphaltic pavement according to an embodiment described herein.

As illustrated in FIG. 2, the reinforcing fabric 100 is used in conjunction with asphaltic paving 200. For instance, the reinforcing fabric 100 may be disposed between a lower layer 202 of an asphaltic surface and an upper layer 204 of an asphaltic surface. In a particular embodiment, the lower asphaltic layer 202 is an existing road surface. In a particular embodiment, the reinforcing fabric 100 directly contacts the lower asphaltic layer 202. Although not illustrated, an optional tack film may directly contact the reinforcing fabric 100, either adjacent to the lower layer 202 or the upper layer 204 of the asphaltic surface. In another embodiment, an optional tack film is not present.

The reinforcing fabric has desirable properties when used with asphaltic applications, such as for the maintenance and repair of existing road surfaces. Desirably the reinforcing fabric can be transported and applied with ease. The reinforcing fabric is not tacky at ambient conditions and has stability in storage and shipping environments. "Ambient" as used herein refers to the surrounding environmental conditions, such as pressure, temperature, or relative humidity. In addition, the reinforcing fabric is semi-rigid, and can be rolled-up for easy transport as a prefabricated, continuous component to the place of installation, where it may be readily rolled out continuously for rapid, economical, and simple incorporation into the roadway.

Many different aspects and embodiments are possible. Some of those aspects and embodiments are described herein. After reading this specification, skilled artisans will appreciate that those aspects and embodiments are only illustrative and do not limit the scope of the present invention. Embodiments may be in accordance with any one or more of the embodiments as listed below.

Embodiment 1

A reinforcing fabric including at least one glass fiber, wherein the at least one glass fiber includes a binder including a polymer resin and a filler, the filler including a recycled asphalt shingle.

Embodiment 2

The reinforcing fabric of Embodiment 1, wherein the polymer resin includes a styrene-based polymer, poly vinyl chloride (PVC), poly(vinylidene chloride) (PVDC), an acrylic polymer, a polyvinyl alcohol, a polyvinyl acetate, an olefinic polymer, an ethylene vinyl acetate copolymer (EVA), a polyamide, an acrylamide, a vinyl ester, or combination thereof.

Embodiment 3

The reinforcing fabric of Embodiment 2, wherein the styrene-based polymer includes a styrene butadiene resin, a styrene acrylic resin, or combination thereof.

Embodiment 4

The reinforcing fabric of Embodiment 1, wherein the filler is present in a range of about 1% by weight to about 99% by weight, such as about 1% by weight to about 80% by weight, or even about 5% by weight to about 50% by weight of a dry coating based on total binder formulation.

Embodiment 5

The reinforcing fabric of Embodiment 1, wherein the filler has a particle size wherein 90% of the particles are less than about 1,300 microns, less than about 1,000 microns, less than about 500 microns, less than about 100 microns, less than about 50 microns, or even less than 34 microns.

Embodiment 6

The reinforcing fabric of Embodiment 1, wherein the binder further includes a crosslinker.

Embodiment 7

The reinforcing fabric of Embodiment 1, wherein the at least one glass fiber includes a first set of strands and a second set of strands, wherein the first and second set of strands are oriented at an angle.

Embodiment 8

The reinforcing fabric of Embodiment 7, wherein the first and second set of strands have an opening between adjacent strands.

Embodiment 9

The reinforcing fabric of Embodiment 1, wherein the strands include E-glass filaments, C-glass, or combination thereof.

Embodiment 10

The reinforcing fabric of Embodiment 1, wherein the binder provides a substantially uniform coating on the at least one glass fiber.

Embodiment 11

The reinforcing fabric of Embodiment 1, wherein the binder is present on the reinforcing fabric in an amount of about 1% by weight to about 50% by weight, such as about 1% by weight to about 30% by weight, or even about 5% by weight to about 15% by weight based on the total weight of the reinforcing fabric.

Embodiment 12

The reinforcing fabric of Embodiment 1, wherein the binder is substantially free of an asphalt resin.

Embodiment 13

The reinforcing fabric of Embodiment 1, further includes a tack film, a release liner, a release coating, or combination thereof on a major surface of the reinforcing fabric.

Embodiment 14

The reinforcing fabric of Embodiment 1, having an adhesive bond to asphaltic paving.

Embodiment 15

The reinforcing fabric of Embodiment 1, wherein a surface of the reinforcing fabric has an increased surface roughness compared to a binder without the recycled asphalt shingle filler.

Embodiment 16

The reinforcing fabric of Embodiment 1, wherein the reinforcing fabric has an increased tensile strength compared to a binder without the recycled asphalt shingle filler.

Embodiment 17

A method of reinforcing paving including: providing a reinforcing fabric over a lower layer of paving, wherein the reinforcing fabric includes at least one glass fiber, wherein the at least one glass fiber includes a binder including a polymer resin and a filler including a recycled asphalt shingle; and applying an upper layer of paving on the reinforcing fabric.

Embodiment 18

The method of Embodiment 17, wherein reinforcing fabric forms an adhesive bond to the lower layer of paving and the upper layer of paving.

Embodiment 19

The method of Embodiment 17, wherein the polymer resin includes a styrene-based polymer, poly vinyl chloride (PVC), poly(vinylidene chloride) (PVDC), an acrylic polymer, a polyvinyl alcohol, a polyvinyl acetate, an olefinic polymer, an ethylene vinyl acetate copolymer (EVA), a polyamide, an acrylamide, a vinyl ester, or combination thereof.

Embodiment 20

The method of Embodiment 17, wherein the filler is present in a range of about 1% by weight to about 99% by weight, such as about 1% by weight to about 80% by weight, or even about 5% by weight to about 50% by weight of a dry coating based on total binder formulation.

Embodiment 21

The method of Embodiment 17, wherein the filler has a particle size wherein 90% of the particles are less than about 1,300 microns, less than about 1,000 microns, less than about 500 microns, less than about 100 microns, less than about 50 microns, or even less than 34 microns.

Embodiment 22

The method of Embodiment 17, wherein the upper layer of paving is applied at a thickness of at least about 40 mm.

Embodiment 23

The method of Embodiment 17, wherein the lower layer of paving is disposed on an existing road surface.

Embodiment 24

The method of Embodiment 17, wherein the existing road surface includes concrete, asphalt, or combination thereof.

The concepts described herein will be further described in the following examples, which do not limit the scope of the invention described in the claims. Some of the parameters below have been approximated for convenience.

EXAMPLES

A reinforcing fabric is provided to better disclose and teach processes and compositions of the present invention. It is for illustrative purposes only, and it must be acknowledged that minor variations and changes can be made without materially affecting the spirit and scope of the invention as recited in the claims that follow.

Example 1

An exemplary binder formulation includes a styrene butadiene rubber (SBR) latex, a recycled asphalt shingle filler, and a crosslinker. The % by weight is of a dry coating based on the total binder formulation and can be seen in Table 1. The recycled asphalt shingle filler is available commercially as Harmonite® 40 wherein 90% of the particles have an equivalent circular diameter of less than 34 microns and 50% of the particles have a size of less than 15 microns, as measured by Malvern Morphologic G3S image analysis. The filler has a volumetric size distribution wherein 90% of the particles are less than 360 microns with less than 50% of the particles being less than 140 microns, as measured by a Beckman Coulter laser diffraction analysis. The remainder of the formulation includes additives for foaming control, rheology control, roll handling, and other functions based on coating machine and process parameters.

TABLE 1

| Example | SBR (% by weight of dry coating) | Recycled asphalt shingle filler (% by weight of dry coating) | Crosslinker (% by weight of dry coating) |
|---|---|---|---|
| 1 | 82 | 10 | 2 |
| 2 | 73 | 19 | 3 |
| 3 | 59 | 34 | 2.7 |

A comparison example includes a styrene butadiene rubber latex (54% by weight of dry coating based on total binder formulation) with a calcium carbonate filler (36% by weight of dry coating based on total binder formulation) and a crosslinking agent (1.8% by weight of dry coating based on total binder formulation) with additives as the remainder of the coating.

The binder examples and comparison example are prepared as a wet coating (including water) and applied to an uncoated fiberglass grid having a basis weight of about 10.375 ounces per square yards. The binder is applied at a thickness of about 0.07 inches to about 0.08 inches. Once the coating dries, tensile strength of the resulting reinforcing fabric is tested via ASTM D6637 Method A and results can be seen in Table 2.

TABLE 2

| Binder | Machine direction (lbs) | Machine direction elongation % | Cross direction (lbs) | Cross direction elongation % |
|---|---|---|---|---|
| Comparison example | 425.4 | 2.0 | 455.7 | 1.7 |
| Example 1 | 618.6 | 2.2 | 662.6 | 1.9 |
| Example 2 | 632.4 | 2.1 | 648.3 | 2.0 |
| Example 3 | 624.1 | 2.1 | 587.6 | 1.9 |

As seen in Table 2, the addition of the recycled asphalt shingle filler improved the tensile strength in both the machine direction and the cross direction for the reinforcing fabric compared to a reinforcing fabric without the recycled asphalt shingle filler.

Certain features, for clarity, described herein in the context of separate embodiments, may also be provided in combination in a single embodiment. Conversely, various features that are, for brevity, described in the context of a single embodiment, may also be provided separately or in any subcombination. Further, reference to values stated in ranges includes each and every value within that range.

Benefits, other advantages, and solutions to problems have been described above with regard to specific embodiments. However, the benefits, advantages, solutions to problems, and any feature(s) that may cause any benefit, advantage, or solution to occur or become more pronounced are not to be construed as a critical, required, or essential feature of any or all the claims.

The specification and illustrations of the embodiments described herein are intended to provide a general understanding of the structure of the various embodiments. The specification and illustrations are not intended to serve as an exhaustive and comprehensive description of all of the elements and features of apparatus and systems that use the structures or methods described herein. Separate embodiments may also be provided in combination in a single embodiment, and conversely, various features that are, for brevity, described in the context of a single embodiment, may also be provided separately or in any subcombination. Further, reference to values stated in ranges includes each and every value within that range. Many other embodiments may be apparent to skilled artisans only after reading this specification. Other embodiments may be used and derived from the disclosure, such that a structural substitution, logical substitution, or another change may be made without departing from the scope of the disclosure. Accordingly, the disclosure is to be regarded as illustrative rather than restrictive.

What is claimed is:

1. A reinforcing fabric comprising at least one glass fiber, wherein the at least one glass fiber comprises a binder comprising a polymer resin and a filler dispersed within the polymer resin, the filler comprising a recycled asphalt shingle, the recycled asphalt shingle comprising an asphalt processed into a roofing product and wherein the binder is substantially free of a virgin asphalt, the virgin asphalt comprising an asphalt not yet processed into a roofing product.

2. The reinforcing fabric of claim 1, wherein the filler is present in a range of about 1% by weight to about 99% by weight of a dry coating based on total binder formulation.

3. The reinforcing fabric of claim 1, wherein the filler has a particle size wherein 90% of the particles are less than about 1,300 microns.

4. The reinforcing fabric of claim 1, wherein the binder further comprises a crosslinker.

5. The reinforcing fabric of claim 1, wherein the strands comprise E-glass filaments, C-glass, or combination thereof.

6. The reinforcing fabric of claim 1, wherein the binder provides a substantially uniform coating on the at least one glass fiber.

7. The reinforcing fabric of claim 1, wherein the binder is present on the reinforcing fabric in an amount of about 1% by weight to about 50% by weight based on the total weight of the reinforcing fabric.

8. The reinforcing fabric of claim 1, wherein the binder is substantially free of an asphalt resin.

9. The reinforcing fabric of claim 1, further comprising a tack film, a release liner, a release coating, or combination thereof on a major surface of the reinforcing grid.

10. The reinforcing fabric of claim 1, having an adhesive bond to asphaltic paving.

11. The reinforcing fabric of claim 1, wherein a surface of the reinforcing fabric has an increased surface roughness compared to a binder without the recycled asphalt shingle filler.

12. The reinforcing fabric of claim 1, wherein the reinforcing fabric has an increased tensile strength compared to a binder without the recycled asphalt shingle filler.

13. The reinforcing fabric of claim 1, wherein the polymer resin comprises a styrene-based polymer, poly vinyl chloride (PVC), poly(vinylidene chloride) (PVDC), an acrylic polymer, a polyvinyl alcohol, a polyvinyl acetate, an olefinic polymer, an ethylene vinyl acetate copolymer (EVA), a polyamide, an acrylamide, a vinyl ester, or combination thereof.

14. The reinforcing fabric of claim 13, wherein the styrene-based polymer comprises a styrene butadiene resin, a styrene acrylic resin, or combination thereof.

15. The reinforcing fabric of claim 1, wherein the at least one glass fiber comprises a first set of strands and a second set of strands, wherein the first and second set of strands are oriented at an angle.

16. The reinforcing fabric of claim 15, wherein the first and second set of strands have an opening between adjacent strands.

17. A method of reinforcing paving comprising:

providing a reinforcing fabric over a lower layer of paving, wherein the reinforcing fabric comprises at least one glass fiber, wherein the at least one glass fiber comprises a binder, wherein the binder comprises a polymer resin and a filler dispersed within the polymer resin, the filler comprising a recycled asphalt shingle, the recycled asphalt shingle comprising an asphalt processed into a roofing product and wherein the binder is substantially free of a virgin asphalt, the virgin asphalt comprising an asphalt not yet processed into a roofing product; and applying an upper layer of paving on the reinforcing fabric.

18. The method of claim 17, wherein reinforcing fabric forms an adhesive bond to the lower layer of paving and the upper layer of paving.

19. The method of claim 17, wherein the polymer resin comprises a styrene-based polymer, poly vinyl chloride (PVC), poly(vinylidene chloride) (PVDC), an acrylic polymer, a polyvinyl alcohol, a polyvinyl acetate, an olefinic polymer, an ethylene vinyl acetate copolymer (EVA), a polyamide, an acrylamide, a vinyl ester, or combination thereof.

20. The method of claim 17, wherein the filler is present in a range of about 1% by weight to about 99% by weight of a dry coating based on total binder formulation.

* * * * *